US007216840B2

(12) United States Patent
Fang

(10) Patent No.: US 7,216,840 B2
(45) Date of Patent: May 15, 2007

(54) SUPPORTING FRAMEWORK FOR A SWIVEL CHAIR OR SWIVEL TABLE

(75) Inventor: Wen-Jie Fang, Kwan Miao Hsiang (TW)

(73) Assignee: Oasyschair Co., Ltd, Tainan Hsien (TW)

( * ) Notice: Subject to any disclaimer, the term of this patent is extended or adjusted under 35 U.S.C. 154(b) by 101 days.

(21) Appl. No.: 10/907,170

(22) Filed: Mar. 23, 2005

(65) Prior Publication Data

US 2006/0214081 A1 Sep. 28, 2006

(51) Int. Cl.
*F16M 13/00* (2006.01)

(52) U.S. Cl. ..... 248/425; 248/418; 248/423; 248/349.1

(58) Field of Classification Search ..... 248/125.8, 248/125.2, 125.1, 669, 651, 658, 654, 161, 248/406.1, 423, 418, 581; 297/344.19; 108/142, 108/139; 403/349, 96, 101, 185, 46, 78; 188/300; 267/120, 64.12
See application file for complete search history.

(56) References Cited

U.S. PATENT DOCUMENTS 1,629,939 A * 5/1927 Turner ..... 248/600
2,377,002 A * 5/1945 Greenwood ..... 248/161
3,230,908 A * 1/1966 Grant ..... 108/142
3,845,926 A * 11/1974 Wahls ..... 248/162.1
3,910,633 A * 10/1975 Marsh ..... 297/344.22
5,297,849 A * 3/1994 Chancellor ..... 297/344.12
5,884,976 A * 3/1999 Breen et al. ..... 297/411.37
6,076,891 A * 6/2000 Bernhardt ..... 297/411.31
6,182,583 B1 * 2/2001 Larson ..... 108/147
2001/0032916 A1 * 10/2001 Wess et al. ..... 248/349.1
2003/0127857 A1 * 7/2003 Boyd et al. ..... 285/330

* cited by examiner

*Primary Examiner*—Carl D. Friedman
*Assistant Examiner*—Bradley Duckworth
(74) *Attorney, Agent, or Firm*—Alan Kamrath; Kamrath & Associates PA

(57) ABSTRACT

A supporting framework for a swivel chair or table includes a gas spring and a cylinder put on the gas spring. The cylinder includes two opposite holes and a plurality of equally circumferentially spaced longitudinal apertures. Spring loaded posts and lock bars are located in the apertures. A fastening ring rests upon the cylinder and includes a plurality of equally circumferentially spaced openings having a diameter less than a diameter of the posts but slightly larger than a diameter of the lock bars. A hollow cap with the gas spring projected therethrough includes two opposite channels of an inverted L-shape. Two, lock pins are inserted through the channels and the holes for fastening the cap and the cylinder together. Moving the lock pins from upper second positions to lower first positions in the channels will enable the gas spring to rotate or vice versa will lock the same.

2 Claims, 7 Drawing Sheets

SUPPORTING FRAMEWORK FOR A SWIVEL CHAIR OR SWIVEL TABLE

BACKGROUND OF THE INVENTION

1. Field of Invention

The present invention relates to an improved supporting framework for a swivel chair, table or the like , with the supporting framework being adapted to lock after a component (e.g., gas spring) thereof rotates a desired angle (i.e., the supporting framework has been positioned).

2. Related Art

Supporting framework for swivel chairs, tables or like office furniture is well known. However, such prior supporting frameworks are typically relatively complex in constructions, costly to manufacture, trouble-prone, and unreliable in use. Thus, continuing improvements in the exploitation of supporting framework for swivel chairs, tables or like office furniture are constantly being sought.

SUMMARY OF THE INVENTION

It is therefore an object of the present invention to provide a supporting framework for a piece of swivel furniture including a sleeve, a cylinder, a gas spring, a ring and a hollow can. The cylinder is put on the gas spring and includes two opposite holes, a top annular flange, and a plurality of equally circumferentially spaced longitudinal apertures open to the flange. A plurality of post are spring loaded in a first group of said apertures. A plurality of lock bars are spring loaded in a second group of said apertures. The number of apertures in the second group is equal to that in the first group. The lock bars are shorter than the posts. The ring rests upon the cylinder, with the gas spring projected through the ring and fastened thereby. The ring includes a plurality of equally circumferentially spaced openings having a diameter less than a diameter of the posts such that the posts are urged upward against the openings but slightly larger than a diameter of the lock bars such that the lock bars are adapted to enter into the openings. The sleeve is put on the cylinder and includes two opposite lock holes. The hollow cap with the gas spring projected therethrough includes two opposite channels of an inverted L-shape on its peripheral wall. Two lock pins are inserted through the channels and the lock holes and into the holes for fastening the cap, the sleeve, and the cylinder together. Thus moving the lock pins from upper second positions to lower first positions in the channels will enable the gas spring to rotate or vice versa will lock the same.

In one aspect of the present invention, the piece of swivel furniture is a swivel chair or a swivel table.

The above and other objects, features and advantages of the present invention will become apparent from the following detailed description taken with the accompanying drawings.

DETAILED DESCRIPTION OF THE INVENTION

Figure 1:
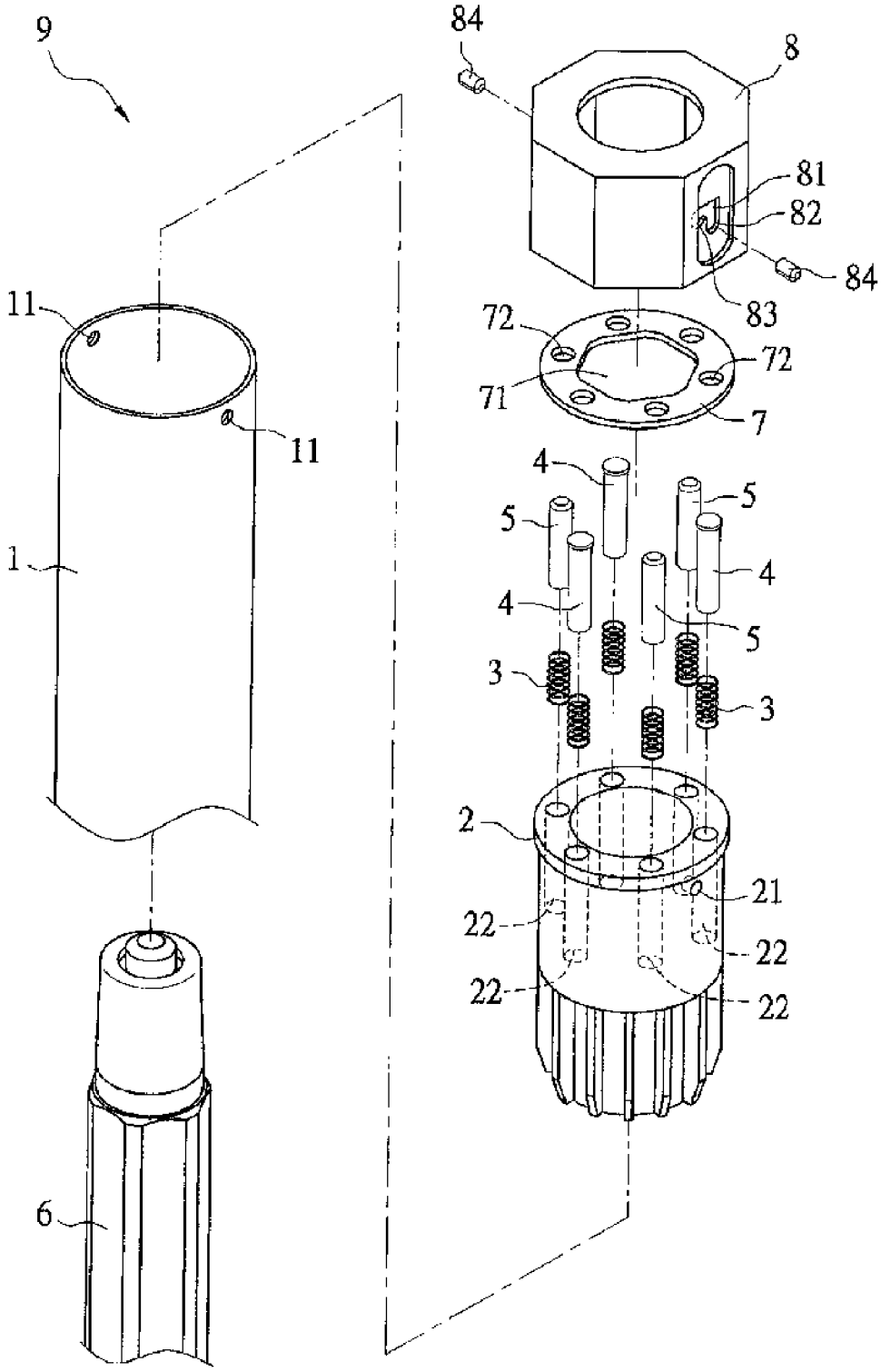
FIG. 1 is an exploded view of a preferred embodiment of a supporting framework according to the invention.
Figure 2:
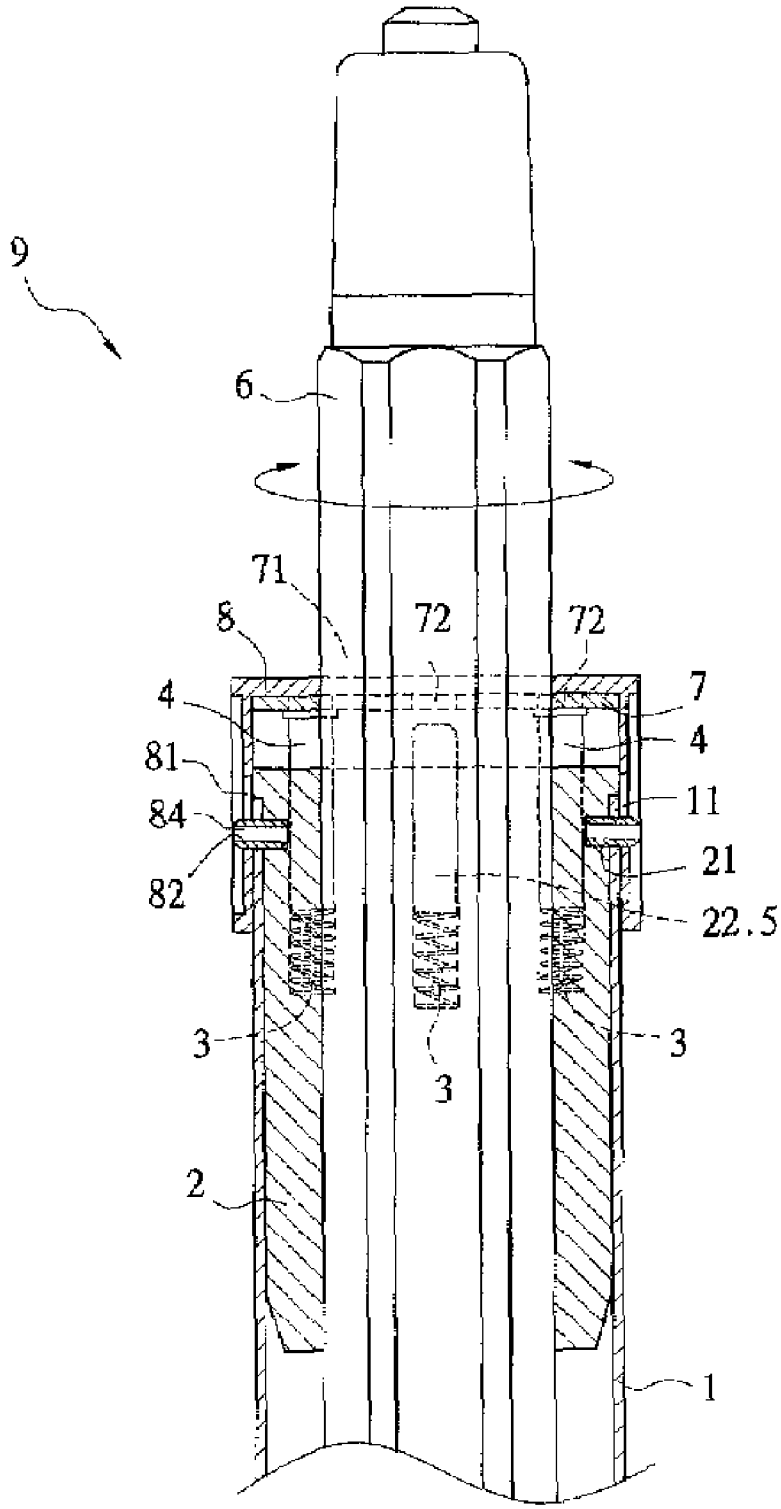
FIG. 2 is a side view, in part section, of the assembled supporting framework in FIG. 1, where the supporting framework is adapted to rotate when a lock pin is disposed in a first position.

Referring to FIGS. 1 and 2, there is shown a supporting framework 9 mounted under a seat of a swivel chair or under a swivel table in accordance with a preferred embodiment of the invention. The supporting framework 9 includes a gas spring 6, and a cylinder 2 put on the gas spring 6. The cylinder 2 includes two opposite holes 21 on its upper portion, and a plurality of longitudinal apertures (six are shown) 22 equally circumferentially spaced on its upper portion. Each longitudinal aperture 22 has an opening on a top annular flange. A plurality of springs (six are shown) 3 is disposed in the longitudinal apertures 22. One of a plurality of posts (three are 4 and a plurality of lock bars (three are shown) 5 are provided in each of the longitudinal apertures 24, with each having a bottom end urged by the spring 3. The lock bars 5 are shorter than the posts 4. A ring 7 rests upon the cylinder 2. The ring 7 includes a central opening 71, with the gas spring 6 projected therethrough and fastened thereby due to conforming shapes. Thus, the gas spring 6 and the ring 7 are adapted to rotate together. The ring 7 further includes a plurality of equally circumferentially spaced peripheral openings 72, having a diameter less than a diameter of tops of the posts 4 but slightly larger than a diameter of the lock bars 5. Thus, the top of each post 4 is urged against the opening 72, and the top of each lock bar 5 is adapted to enter into the opening 72. A sleeve 1 includes two opposite lock holes 11 on its upper portion, with the sleeve 1 being put on the cylinder 2 with the lock holes 11 aligned with the holes 2l. A cap 8 rests upon the ring 7 and includes a central opening with the gas spring 6 projected therethrough. Two opposite channels 81 of an inverted L-shape are on the peripheral wall of the can 8. Two lock pins 84 are inserted through the channels 81 and the lock holes 11 and into the holes 21 for fastening the cap 8, the sleeve 1, and the cylinder 2 together.

Figure 3:
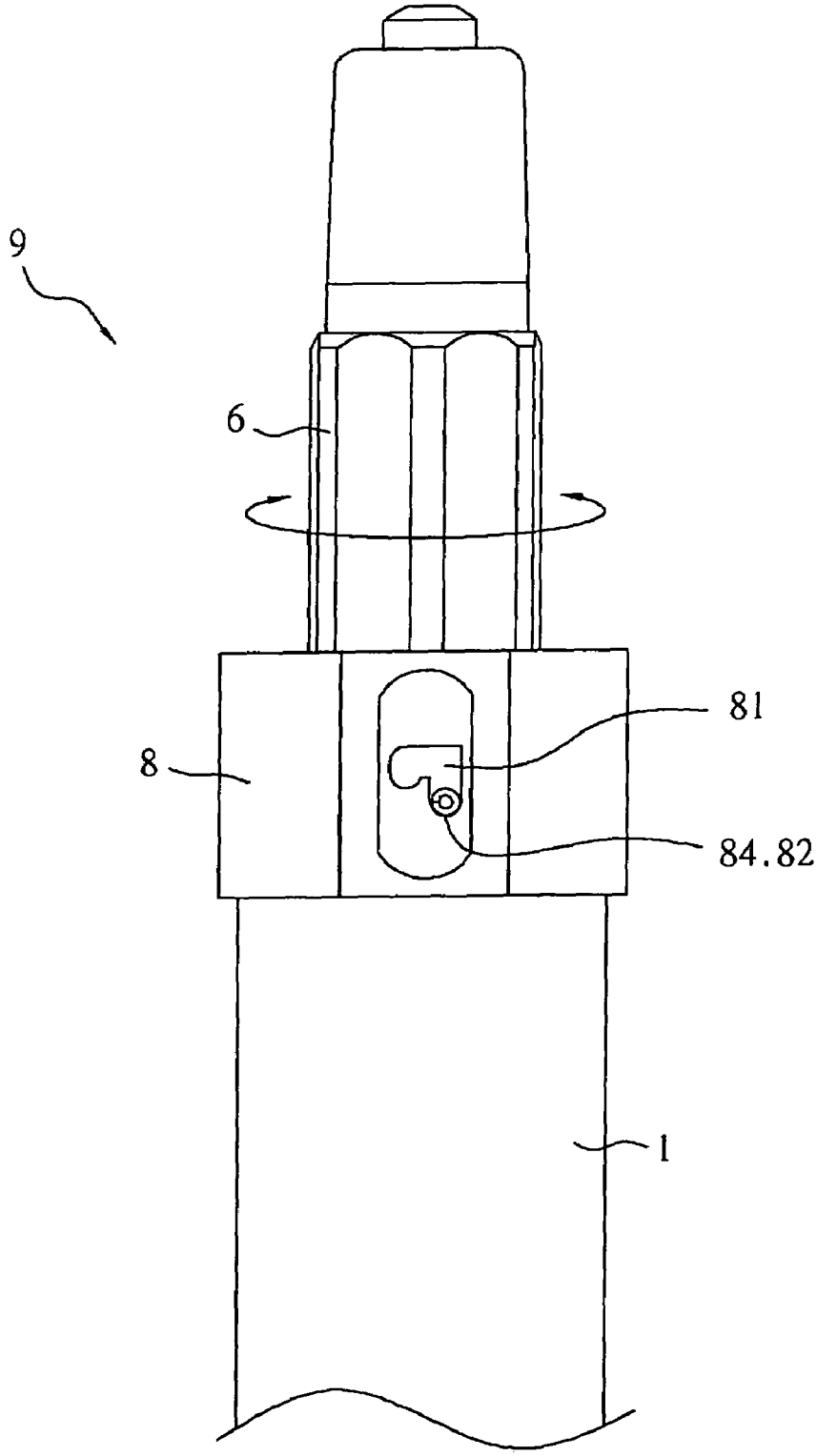
FIG. 3 is a side view of the assembled supporting framework in FIG. 1, where the supporting framework is adapted to rotate when the lock pin is disposed in the first position.
Figure 4:
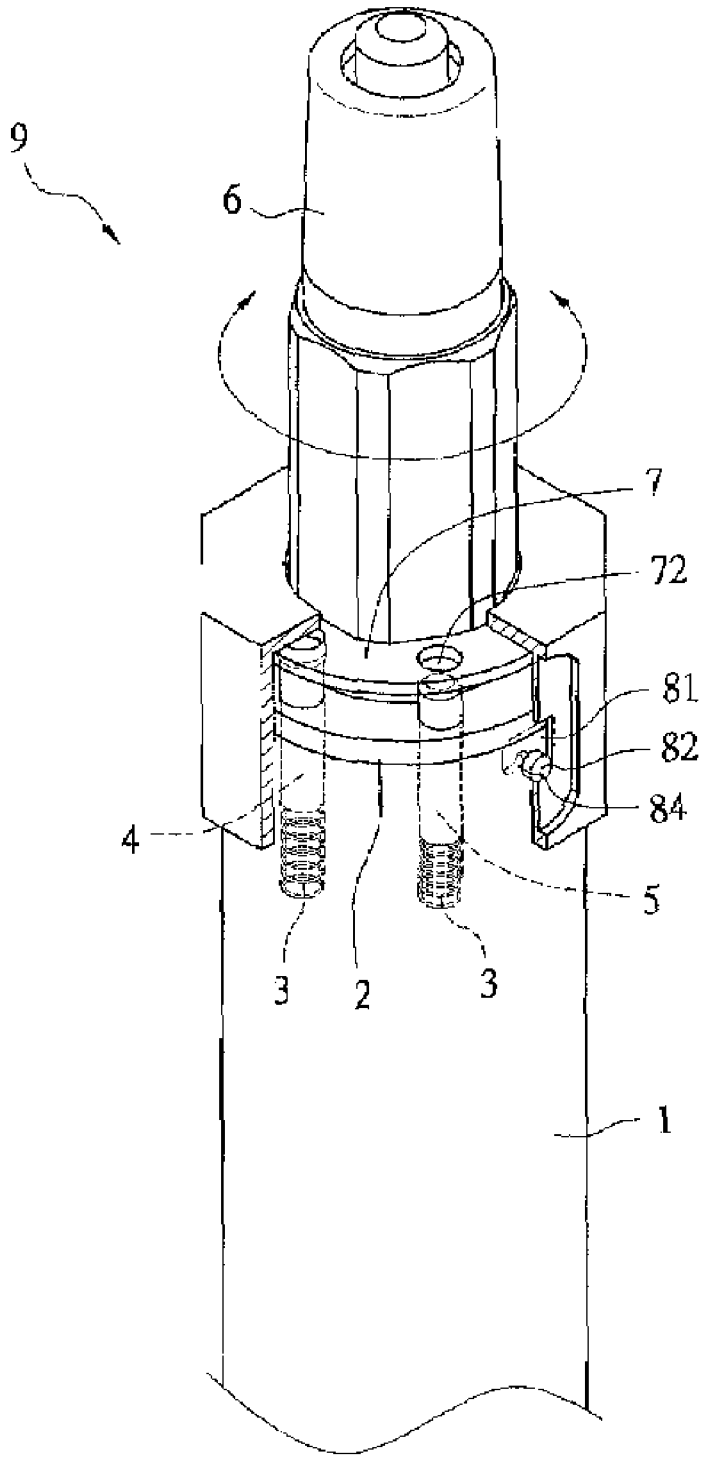
FIG. 4 is a perspective view, with a portion broken away, of the assembled supporting framework in FIG. 1, where the supporting framework is adapted to rotate when the lock pin is disposed in the first position.

Referring to FIGS. 3 and 4 in conjunction with FIG. 2, a user may rotate the cap 8 a small angle and then lift the same to move the lock pins 84 to lower first positions 82 of the channels 81. The posts 4 are adapted to push the ring 7 and the cap 8 upward due to expansion of the springs 3 while the lock pins 84 are in the lower first positions 82 of the channels 81. The openings 72 of the ring 7 then separate from the lock bars 5. The gas spring 6 is, thus, able to rotate freely for adjusting orientation of a chair or table.

Figure 5:
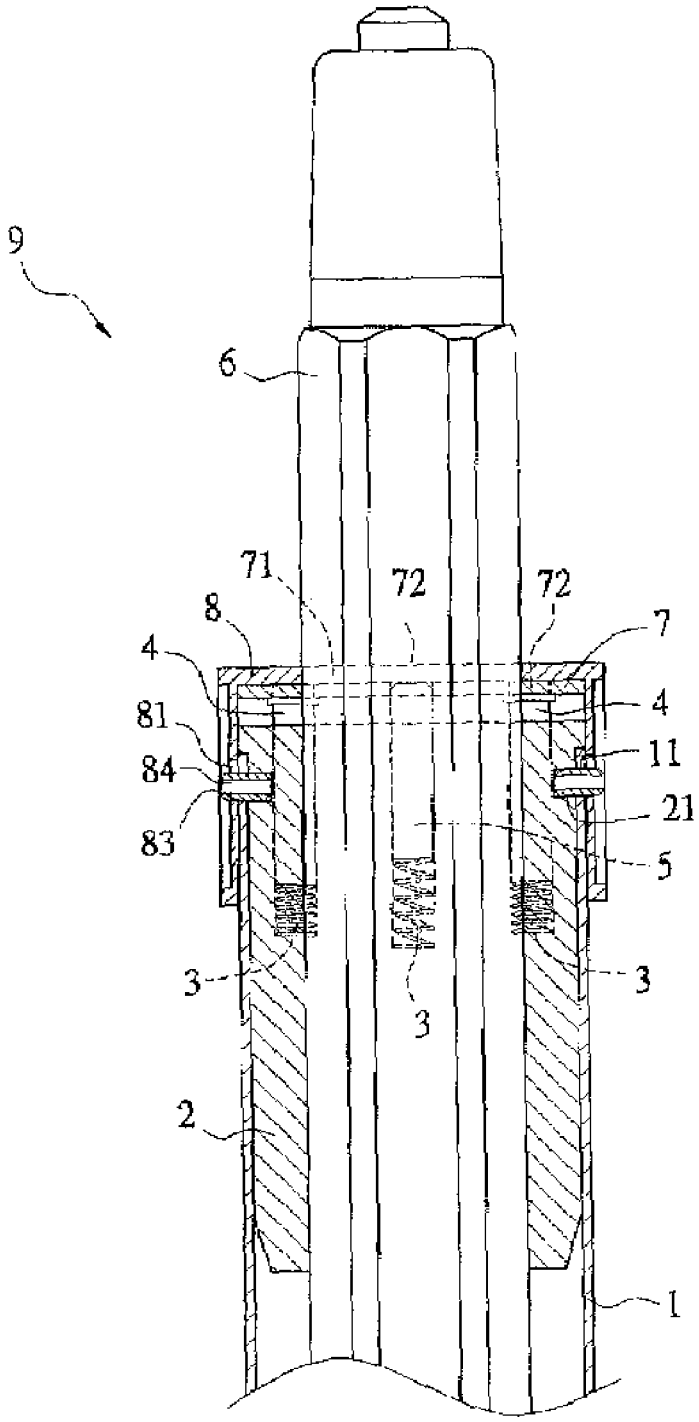
FIG. 5 is a view similar to FIG. 2, where the supporting framework is locked when the lock pin is disposed in a second position.
Figure 6:
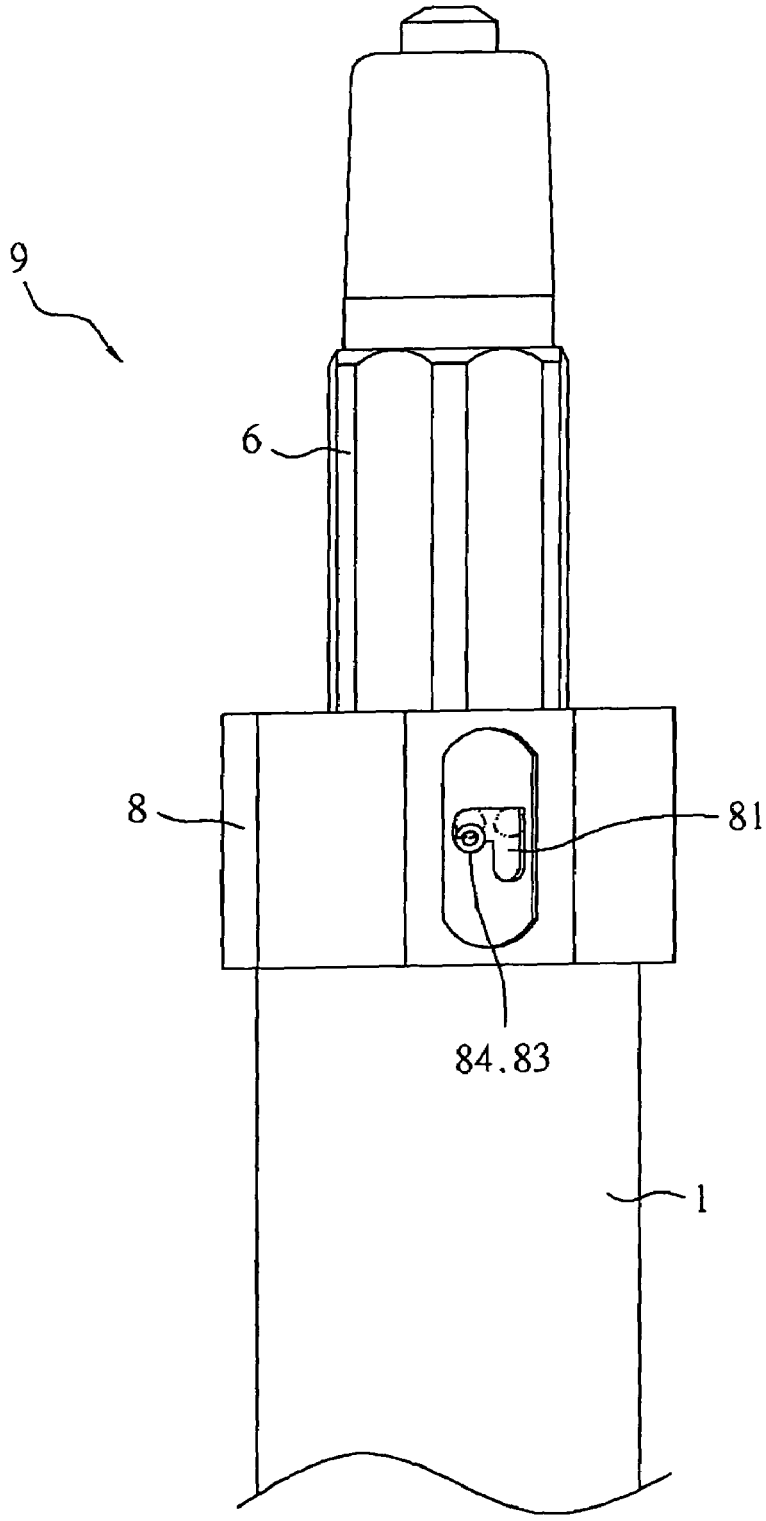
FIG. 6 is a view similar to FIG. 3, where the supporting framework is locked when the lock pin is disposed in the second position.
Figure 7:
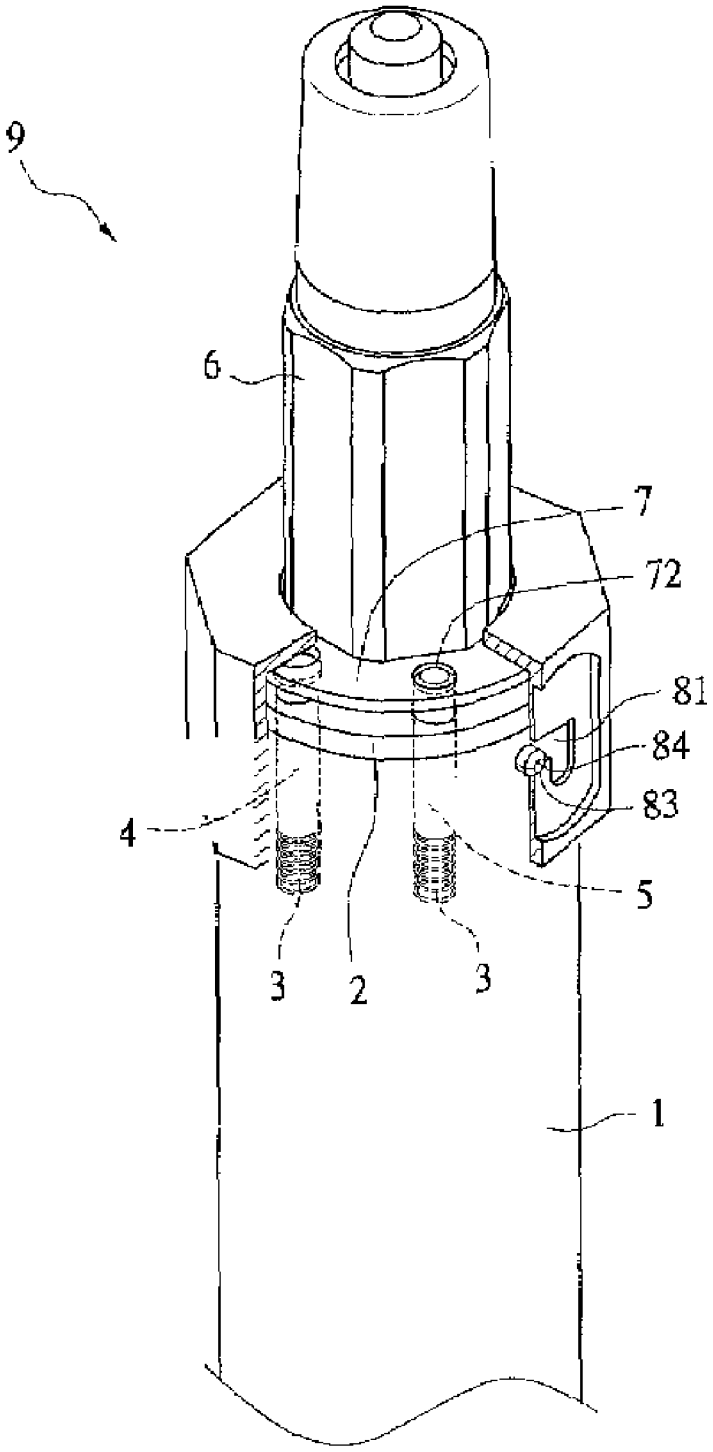
FIG. 7 is a view similar to FIG. 4, where the supporting framework is locked when the lock pin is disposed in the second position.

Referring to FIGS. 5, 6, and 7, and for locking the supporting framework 9 after the chair or table has been positioned in the desired orientation, a user may first press the cap 8 to cause the lock pins 84 to move against the upper edges of the lower first positions 82. At that time, can 8 can be rotated to move the lock pins 84 from the lower first positions 82 to upper second positions 83 in the channels 81.

The downward movement of the cap 8 causes the posts 4, the lock bars 5 inside the ring 7 and the cylinder 2 to move downwardly. The gas spring 6 can then be rotated a small angle to align the openings 72 of the ring 7 with the lock bars 5. The lock bars 5, thus, hoist to enter into the openings 72 of the ring 7 (i.e., the gas spring 6 is locked) due to expansion of the springs 3.

While the invention herein disclosed has been described by means of specific embodiments, numerous modifications and variations could be made thereto by those skilled in the art without departing from the scope and spirit of the invention set forth in the claims.

What is claimed is:

1. A supporting framework for a piece of swivel furniture, comprising:

a gas spring;

a cylinder put on the gas spring and comprising two opposite holes, a top annular flange, and a plurality of equally circumferentially spaced longitudinal apertures, with each aperture being open to the flange;

a plurality of posts;

a plurality of lock bars;

a plurality of springs loading said posts disposed in a first group of said apertures;

a plurality of springs loading said lock bars disposed in a second group of said apertures, with the number of the apertures in the second group being equal to that in the first group, with the lock bars being shorter than the posts;

a ring rested upon the cylinders with the gas spring projected through the ring and fastened thereby, with the ring comprising a plurality of equally circumferentially spaced openings having a diameter less than a diameter of the posts such that the posts are urged upward against the openings but slightly larger than a diameter of the lock bars such that the lock bars are adapted to enter into the openings;

a sleeve put on the cylinder, with the sleeve comprising two opposite lock holes;

a hollow cap, with the gas spring projected through the hollow cap, with the hollow cap comprising two opposite channels of an inverted L-shape on a peripheral wall; and two lock pins inserted through the channels and the lock holes and into the holes for fastening the cap, the sleeve, and the cylinder together; whereby:

rotating the cap a small predetermined angle and lifting will move the lock pins from upper second positions to lower first positions of the channels to enable the gas spring to rotate freely for adjusting an orientation thereof; and pressing the cap and rotating will move the lock pins from the lower first positions to the upper second positions of the channels, and rotating the gas spring a small predetermined angle will align the openings with the lock bars for raising the lock bars to enter into the openings for locking the gas spring after being positioned in the orientation.

2. The supporting framework of claim 1, wherein the plurality of springs loading said posts in the first group of said apertures are of a same type as the plurality of springs loading said locking bars in the second group of said apertures.

* * * * *